US006510876B2

(12) United States Patent
Camacho et al.

(10) Patent No.: US 6,510,876 B2
(45) Date of Patent: Jan. 28, 2003

(54) ADAPTER FOR A COOLANT TRANSFER MACHINE, METHODS OF TRANSFERRING COOLANT AND KIT

(75) Inventors: Michael J. Camacho, Rancho Cucamonga, CA (US); Carl Brod, San Dimas, CA (US)

(73) Assignee: MOC Products Company, Inc., Pacoima, CA (US)

( * ) Notice: Subject to any disclaimer, the term of this patent is extended or adjusted under 35 U.S.C. 154(b) by 64 days.

(21) Appl. No.: 09/850,831

(22) Filed: May 8, 2001

(65) Prior Publication Data

US 2002/0166603 A1 Nov. 14, 2002

(51) Int. Cl.[7] ..... B65B 1/04

(52) U.S. Cl. ..... 141/98; 141/65; 141/367; 184/1.5

(58) Field of Search ..... 141/98, 67, 65, 141/59, 367, 378; 184/1.5, 105.3; 285/12, 305, 308, 81, 84

(56) References Cited

U.S. PATENT DOCUMENTS 4,782,689 A 11/1988 De Rome
4,888,980 A 12/1989 De Rome
5,370,160 A 12/1994 Parker
5,472,064 A 12/1995 Viken
5,573,045 A 11/1996 Akazawa
5,615,716 A 4/1997 Akazawa
5,806,629 A 9/1998 Dixon et al.
5,853,068 A 12/1998 Dixon et al.
6,112,855 A 9/2000 Camacho et al.
6,131,701 A 10/2000 Camacho et al.
6,135,136 A 10/2000 Klamm
6,152,193 A 11/2000 Klamm
6,161,566 A 12/2000 Klamm
6,165,567 A 12/2000 Ventzek et al.
6,213,175 B1 4/2001 Rome et al.

*Primary Examiner*—Steven O. Douglas
(74) *Attorney, Agent, or Firm*—John J. Connors; Connors & Assoc., Inc.

(57) ABSTRACT

An adapter connects different sized conduits to a radiator, where each conduit has an open end configured differently than the open ends of the other conduits. The adapter includes a body member having a cavity therein, with a connection member having one end extending from the body member to be attached to a coupling member and another end in communication with the cavity. A passageway extends between these ends. Tubular inserts are individually and independently coupled to one sized conduit. Each insert has a first end sized to fit snug within the cavity and a second opposed end sized to fit within an open end of one of the conduits.

10 Claims, 5 Drawing Sheets

ADAPTER FOR A COOLANT TRANSFER MACHINE, METHODS OF TRANSFERRING COOLANT AND KIT

BACKGROUND OF THE INVENTION

Servicing of automotive vehicles typically requires periodic replacement of the coolant for the radiator of the vehicle's engine. Fluid transfer machines such as, for example, illustrated in U.S. Pat. Nos. 4,782,689; 4,888,980; 5,573,045; 5,615,716; 6,135,136; 6,152,193; 6,161,566; and 6,213,175, are sometimes used to transfer the used coolant to a storage vessel while replacing this used coolant with new coolant. An adapter is sometimes used to provide the necessary connection between coupling members on the ends of hoses from the fluid transfer machine and the radiator. Ideally this adapter, or a set of adapters, is sized to accommodate the different sized inlets and outlets of the radiators typically employed in vehicles made by the major manufacturers.

SUMMARY OF THE INVENTION

This invention has several features, no single one of which is solely responsible for its desirable attributes. Without limiting the scope of this invention as expressed by the claims that follow, its more prominent featured will now be discussed briefly. After considering this discussion, and particularly after reading the section entitled, "DETAILED DESCRIPTION OF THE PREFERRED EMBODIMENT," one will understand how the features of this invention provide its benefits, which include, but are not limited to, convenience of use and applications to a variety of different engines with varying sized radiator conduits, and improved safety.

The first feature of the adapter of this invention is that it has the ability to be connected to different sized outlet or inlet conduits of a radiator for an automotive vehicle. Different makes of automobile vehicles employ radiator conduits having an open ends configured differently. The adapter of this invention is designed to be connected with a number of such differently sized radiator conduits or to the point of connection where the radiator conduit is attached to the radiator.

The second feature is that the adapter of this invention includes a body member having a cavity therein. The body member is made of an insulating material. Consequently, the heat from the radiator does not excessively heat the body member to avoid possible burning of a technician who is using the adapter. The cavity has a cylindrical shaped sidewall of a predetermined diameter and predetermined height, and a substantially flat bottom. An "O" ring seated in the sidewall assist in making a fluid tight connection when a conduit is placed in the cavity.

The third feature is a connection member having a first end extending from the body member to be attached to a coupling member and a second end in communication with the cavity. This connection member has a passageway extending from the first end to the second end. The first end is normally closed but opens upon the connection member being attached to the coupling member to allow fluid to flow through the passageway into the cavity.

The fourth feature is that a plurality of tubular insert members are used, but only one is selected based upon the size of the radiator conduit for the vehicle being serviced. The inserts are individually and independently coupled to an end of a radiator conduit that is detached from the point of connection to the radiator or to a end of a replacement conduit that connects an adapter to the point of connection to the radiator. Each insert member has a first end sized to fit snug within the cavity and a second opposed end sized to fit within an open end of one of the conduits, either the detached radiator conduit or the replacement conduit. The size of these first ends of each insert member is substantially identical and the size of the second ends of each insert member is substantially different and configured to fit within only one open end of one of the conduits. Preferably, the first end of each insert member has a substantially cylindrical shaped sidewall with a predetermined diameter and height substantially equal to the predetermined diameter and predetermined height of the cylindrical shaped sidewall of the cavity. Preferably, the first end of each insert member terminates in a substantially flat bottom that abuts the bottom of the cavity upon insertion of the insert member into the cavity. Typically, each tubular insert member has an inside diameter, and this inside diameters of each insert member are of equal diameter. In the preferred embodiment of this invention, the first end of each insert member has an annular groove therein with a recess in the groove and the body member has a manually moveable locking pin extending there through with a terminal tip that rides in the groove and fits into the recess upon alignment therewith to lock the insert member to the body member.

This invention also includes a kit used to connect a coolant fluid transfer machine to an automotive engine. The kit includes at least one set of conduits and at least one set of adapters. Each conduit has a different inside diameter, and each conduit each have an open end configured differently than the open ends of the other conduits. Each adapter is constructed as discussed above.

This invention also includes a method of transferring coolant between a fluid transfer machine having a hose terminating in a coupling member and an automotive engine having a pair of radiator conduits, each having an inside diameter, typically both the same. One radiator conduit is connected to an inlet of a radiator for the automotive engine and the other radiator conduit connected to an outlet of said radiator. The method comprises (a) disconnecting one of the radiator conduits, (b) substituting for the disconnected radiator conduit a replacement conduit, said replacement conduit having a length that is less than 3 inches, an inside diameter that is substantially the same as the inside diameter of the disconnected radiator conduit, and opposed open ends, with one of the open ends being attached to the radiator inlet or outlet depending on which radiator conduit has been disconnected, (c) providing an adapter including a body member having a cavity therein, a connection member having a first end extending from the body member that is adapted to be attached to the coupling member of the hose and a second end in communication with the cavity, said connection member having a passageway extending from the first end to the second end, with said first end being normally closed but opening upon the connection member being attached to said coupling member to allow fluid to flow through the passageway and cavity, and a plurality of tubular insert members, one of said insert members being individually and independently adapted to be coupled to one sized replacement conduit, each insert member having a first end sized to fit snug within the cavity and a second opposed end sized to fit only within an open end of one of a plurality of different sized replacement conduits, (d) selecting the tubular insert that has a second end that fits within the replacement conduit substituted for the disconnected radiator conduit and inserting said second end of this selected insert into the open end of the replacement conduit, and placing the first end of the selected tubular insert into the cavity, and (e) connecting the coupling member to the first end of the connection member.

This invention also includes a method of transferring coolant between a fluid transfer machine and a radiator for the automotive engine. The fluid transfer machine has a first hose terminating in a first coupling member and a second hose terminating in a second coupling member and the automotive engine has a pair of radiator conduits extending between the radiator for the automotive engine and the automotive engine. Each radiator conduit has an inside diameter, typically both the same. One radiator conduit has a first end connected to the radiator at a first connection point and a second end connected to the engine and another radiator conduit has a first end connected to the radiator at a second connection point and a second end connected to the engine. The method comprises (a) disconnecting the first end of one of the radiator conduits from the radiator but leaving the second end of said disconnected radiator conduit connected to the engine, (b) attaching a replacement conduit to the radiator at the point of connection of the disconnected radiator conduit, said replacement conduit having a length that is less than 3 inches, an inside diameter that is substantially the same as the disconnected radiator conduit, and an open end with an inside diameter substantially the same as the disconnected radiator conduit, (c) providing first and second adapters, each adapter including a body member having a cavity therein, a connection member having a first end extending from the body member that is adapted to be attached to a coupling member of one hose of the fluid transfer machine and a second end in communication with the cavity, said connection member having a passageway extending from the first end to the second end, with said first end being normally closed but opening upon the connection member being attached to said coupling member to allow fluid to flow through the passageway and cavity, and a plurality of tubular insert members, one of said insert members being individually and independently adapted to be coupled to one sized replacement conduit, each insert member having a first end sized to fit snug within the cavity and a second opposed end sized to fit only within an open end of one of a plurality of different sized replacement conduits, (d) connecting the first adapter to the open end of the replacement conduit, including selecting the tubular insert that has a second end that fits within the replacement conduit attached to the connection point, inserting said second end of said selected insert into the open end of the replacement conduit, placing the first end of the selected tubular insert into the cavity of said first adapter, and connecting the first coupling member to the first end of the connection member of the first adapter, and (e) connecting the second adapter to the open end of the radiator conduit still connected to the engine, including selecting the tubular insert that has a second end that fits within the open end of the radiator conduit still connected to the engine, inserting said second end of said selected insert into the open end of the radiator conduit still connected to the engine, placing the first end of the selected tubular insert into the cavity of said second adapter, and connecting the second coupling member to the second end of the connection member of the second adapter.

This invention also includes a method of replacing coolant in a radiator that flows through a radiator conduit to an automotive engine. The radiator conduit has first and second opposed ends. The method comprises (a) detaching one end of the radiator conduit connected to the radiator and leaving the other end of said the radiator conduit connected to the engine, (b) attaching one end of a replacement conduit to the radiator to replace the radiator conduit and attaching another end of the replacement conduit to a fluid transfer machine via a first adapter having a removable insert with a predetermined size substantially the same as the disconnected radiator conduit to enable the one end of the replacement conduit to be connected to the radiator, said fluid transfer machine being in communication with a source of new coolant and having a first outlet for used coolant from the radiator and a second outlet for new coolant to be fed to the engine, (c) connecting the second outlet of the fluid transfer machine to the engine via a second adapter having a removable insert with a predetermined size substantially the same as the disconnected radiator conduit to enable the second adapter to be connected to the engine.

DESCRIPTION OF THE DRAWING

The preferred embodiment of this invention, illustrating all its features, will now be discussed in detail. This embodiment depicts the novel and non-obvious adapter of this invention, methods of using this adapter, and an adapter kit as shown in the accompanying drawing, which is for illustrative purposes only. This drawing includes the following figures (Figs.), with like numerals indicating like parts.

DETAILED DESCRIPTION OF THE PREFERRED EMBODIMENT

Figure 1:
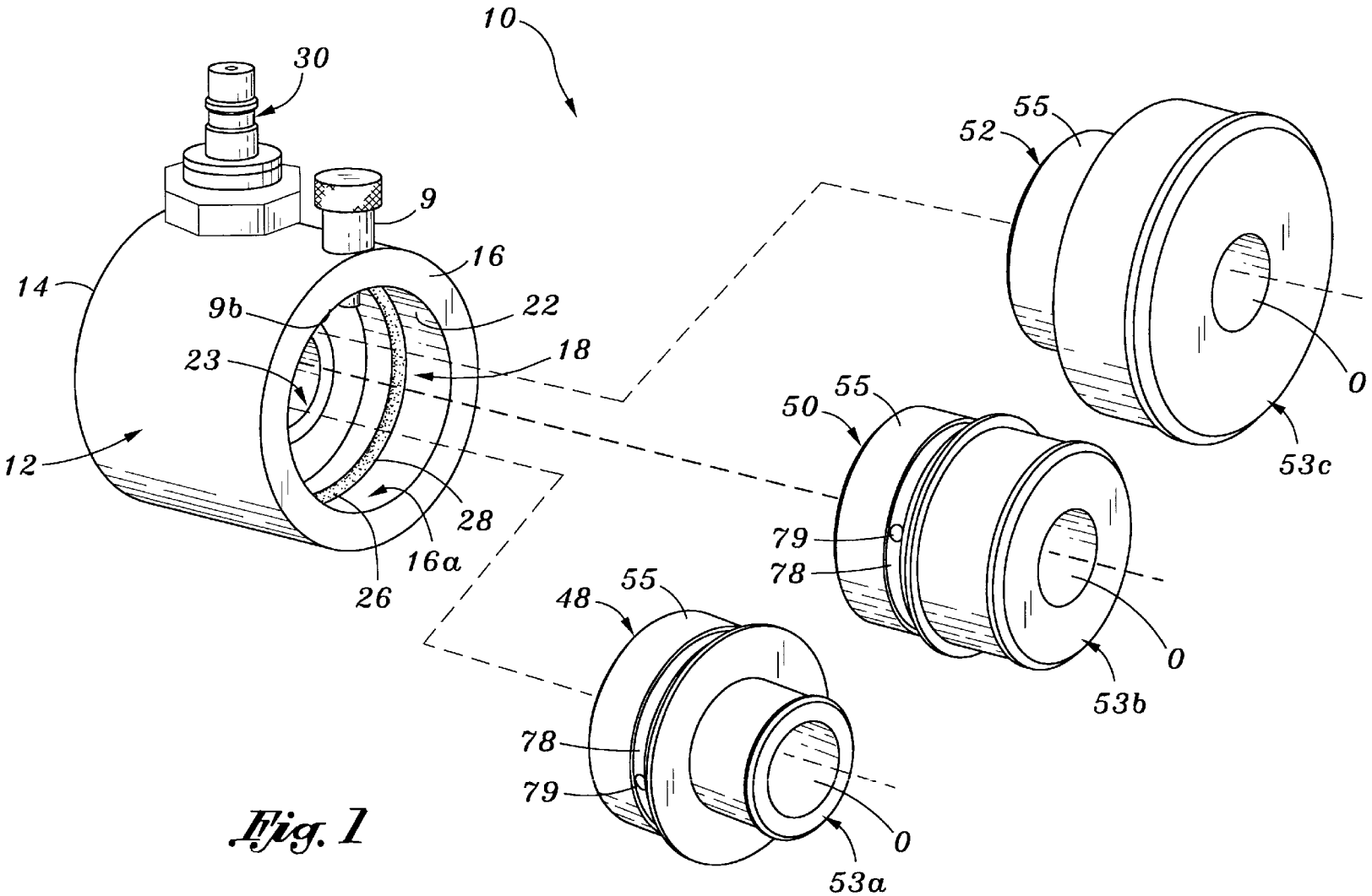
FIG. 1 is an exploded perspective view of the adapter of this invention showing the three different sized inserts, only one of which to be inserted into the body of the adapter.
Figures 2A, 2B, 2C, 3A, 3B, 3C, 4A, 4B, 4C:
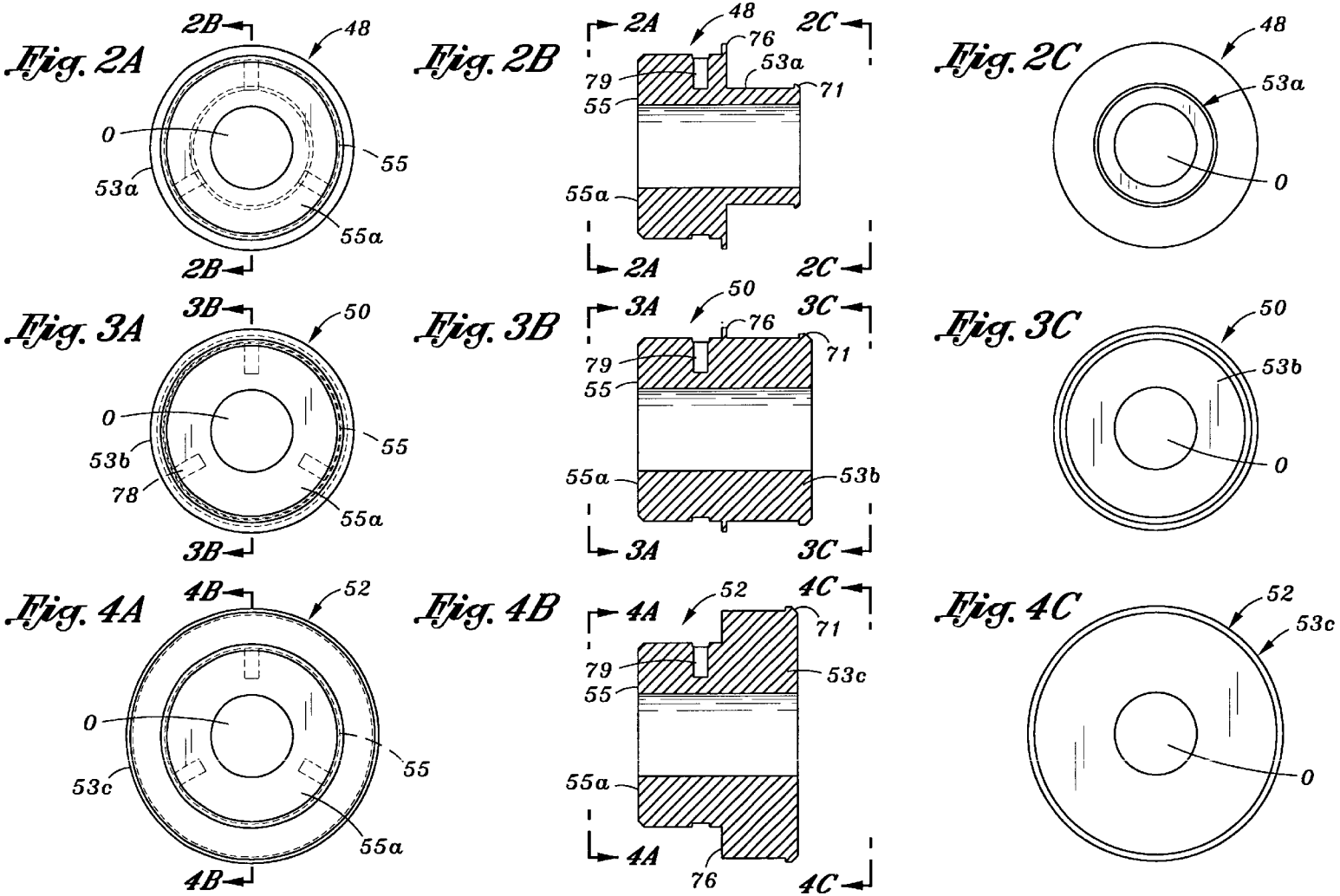
FIG. 2A is an end view of the small sized insert taken along line 2A—2A of FIG. 2B, showing the end to be inserted into the body of the adapter.
FIG. 2B is a cross-sectional view of the small sized insert taken along line 2B—2B of FIG. 2A.
FIG. 2C is an end view of the small sized insert taken along line 2C—2C of FIG. 2B, showing the end to be inserted into a conduit.
FIG. 3A is an end view of the small sized insert taken along line 3A—3A of FIG. 3B, showing the end to be inserted into the body of the adapter.
FIG. 3B is a cross-sectional view of the small sized insert taken along line 3B—3B of FIG. 3A.
FIG. 3C is an end view of the small sized insert taken along line 3C—3C of FIG. 3B, showing the end to be inserted into a conduit.
FIG. 4A is an end view of the small sized insert taken along line 4A—4A of FIG. 4B, showing the end to be inserted into the body of the adapter.
FIG. 4B is a cross-sectional view of the small sized insert taken along line 4B—4B of FIG. 4A.
FIG. 4C is an end view of the small sized insert taken along line 4C—4C of FIG. 4B, showing the end to be inserted into a conduit.
Figure 6B:
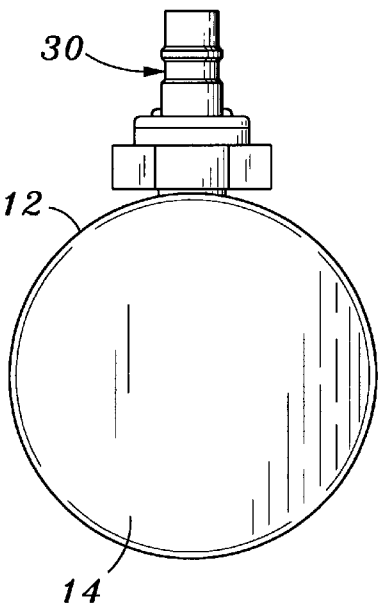
FIG. 6B is a rear elevational view of the body of the adapter taken along line 6B—6B of FIG. 6A.

As shown in FIG. 1, the adapter 10 of this invention includes a cylindrical body 12 having a closed rear end 14 (FIG. 6B) and, in its front end 16, a cylindrical cavity 18 with a flat, annular bottom 20 and cylindrical sidewall 22 extending upward from this bottom. The annular bottom 22 encircles a well 23. The cavity 18 is co-axial with the longitudinal axis X (FIG. 6A) of the body 12 and its has a circular shaped open mouth 16*a* with the longitudinal axis inserting its center C at a right angle. There is an "O" ring 26 seated in an annular indentation 28 in the sidewall 22 about mid-way between the open mouth 16*a* and the bottom 20.

Figure 6A:
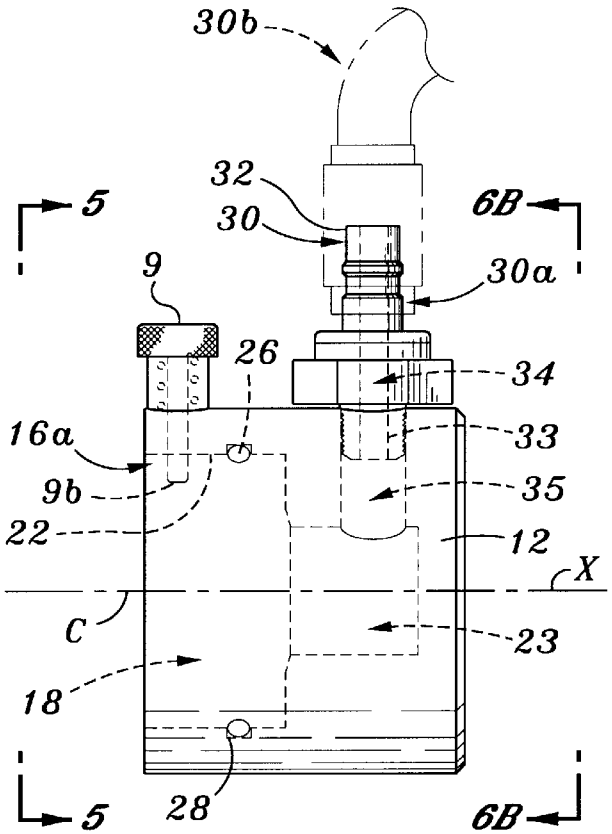
FIG. 6A is a side elevational view of the body of the adapter taken along line 6A—6A of FIG. 5.
Figure 5:
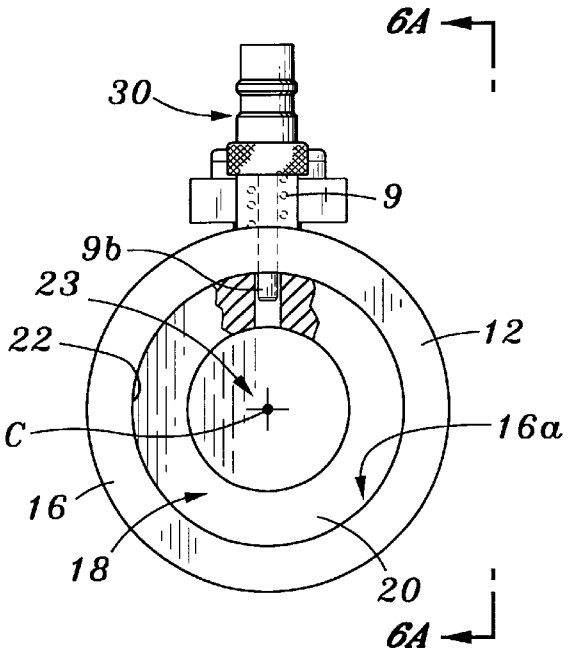
FIG. 5 is a front elevational view of the front of the body of the adapter, taken along line 5—5 of FIG. 6A, with sections broken away, showing the cavity into which an insert is placed.
Figure 7B:
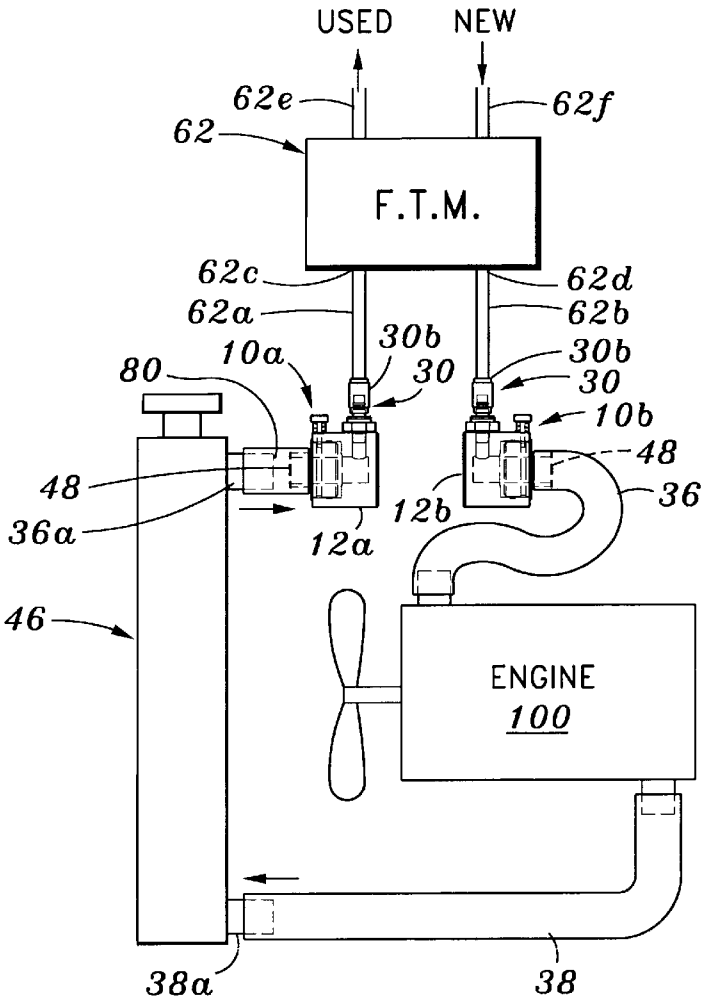
FIG. 7B is a schematic view illustrating the manner in which a fluid transfer machine (FTM) is connected to the automotive engine and radiator for the engine using a pair of adapters of this invention.

Extending outward radially from the body 12 is a spring 9*a* loaded locking pin 9 having a tip 9*b* extending into the cavity near its open mouth 16*a*, and male component 30*a* of a conventional quick connect-disconnect coupling member 30 (FIG. 6A). As shown in phantom in FIG. 6A, the female component 30*b* of the quick connect-disconnect coupling member 30 locks onto the male component 30*a* when adapters 10*a* and 10*b* of this invention are connected to a fluid transfer machine 62 as shown in FIG. 7B. There is a female component 30*b* attached to each hose 62*a* and 62*b* extending from the fluid transfer machine 62. The hose 62*a* is connected to an inlet 62*c* for used coolant from the radiator 46 and the hose 62*b* is connected to an outlet 62*d* for new coolant fluid from a source of such fluid that is fed into the fluid transfer machine 62 through an inlet 62*f*. Used coolant from the radiator 46 exits the fluid transfer machine 62 through an outlet 62*e*. The exterior end 32 of the male component 30*a* is inserted into the female component 30*b* of each quick connect-disconnect coupling member 30 during transfer of coolant fluid and then detached upon completion of the transfer of fluid. This exterior end 32 is normally closed, but is opened upon connection of the male and female components 30*a* and 30*b* of the quick connect-disconnect coupling member 30. The interior end 33 (FIG. 6A) of the male component 30 of the quick connect-disconnect coupling member 30 is open, and it terminates at a tunnel 35 within the body 12 that is in communication with the well 23 inside the body 12. There is a passageway 34 (shown in dotted lines) extending lengthwise through this male component 30 from the exterior end 32 to the interior end 33 to allow coolant fluid to flow through the passageway 34 when the normally closed end is opened. The fluid exits the interior end 33 and flows through the tunnel 25 and well 23 and out the mouth 16*a* of the cavity 16.

Figure 7A:
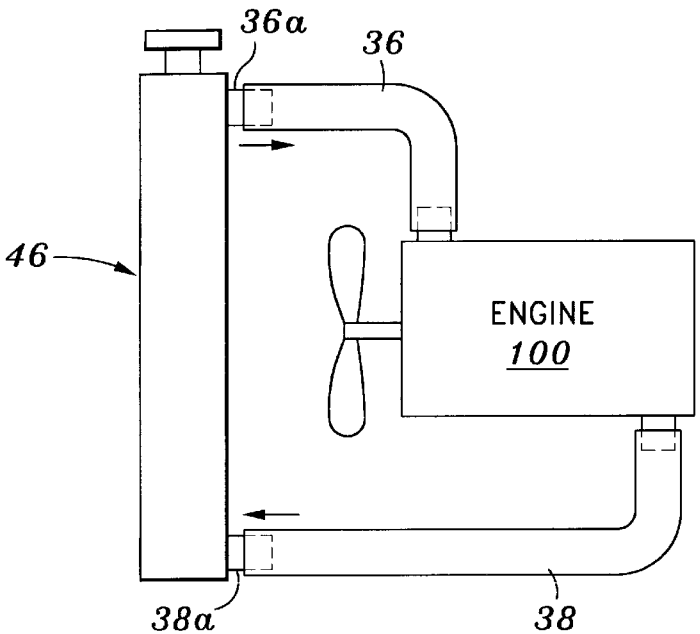
FIG. 7A is a schematic view illustrating the manner in which an automotive engine is connected to a radiator for the engine.

A plurality of inserts 48, 50 and 52 (FIGS. 2A through 4C) are used with the body 12 to construct an adapter of this invention that is correctly sized for the vehicle being serviced. As illustrated in FIG. 7A, a vehicle's engine 100 has an outlet conduit 36 and an inlet conduit 38 attached to a radiator 46. Typically, the conduit 36 and conduit 38 are held in position by clamps (not shown). Upon connection to the fluid transfer machine 62, only one conduit, either outlet conduit 36 or inlet conduit 38, is disconnected from the radiator 46 at its point of connection, respectively, the outlet 36*a* or inlet 38*a*. As illustrated in FIG. 7B, one adapter 10*b* is connected between the fluid transfer machine 62 and the conduit 36 that has been detached from the radiator 46. This conduit 36 remains attached to the engine 100. Another adapter 10*a* is connected between the fluid transfer machine 62 and the radiator 46. A correctly sized replacement conduit and pair of inserts are selected from a kit 70 (FIG. 8) holding the necessary number of components to construct the pair of adapters 10*a* and 10*b* based on the dimensions of the inside diameters of the detached inlet or outlet conduit for the particular vehicle being serviced.

There are two set of inserts: set A and set B, with three inserts per set: a small sized insert 48, a medium sized insert 50, and a large sized insert 52. Only one insert is used with an adapter body 12. The insert (48, 50, or 52) selected depends on the size of the inlet 36*b* or outlet 36*a* to which an adapter is connected or the size of the engine conduit 36 or 38 into which the adapter is connected. Each of these inserts 48, 50, and 52 is substantially identical, except for an end, 53*a*, 53*b*, and 53*c*, respectively, that is to be attached to a replacement conduit.

Figure 8:
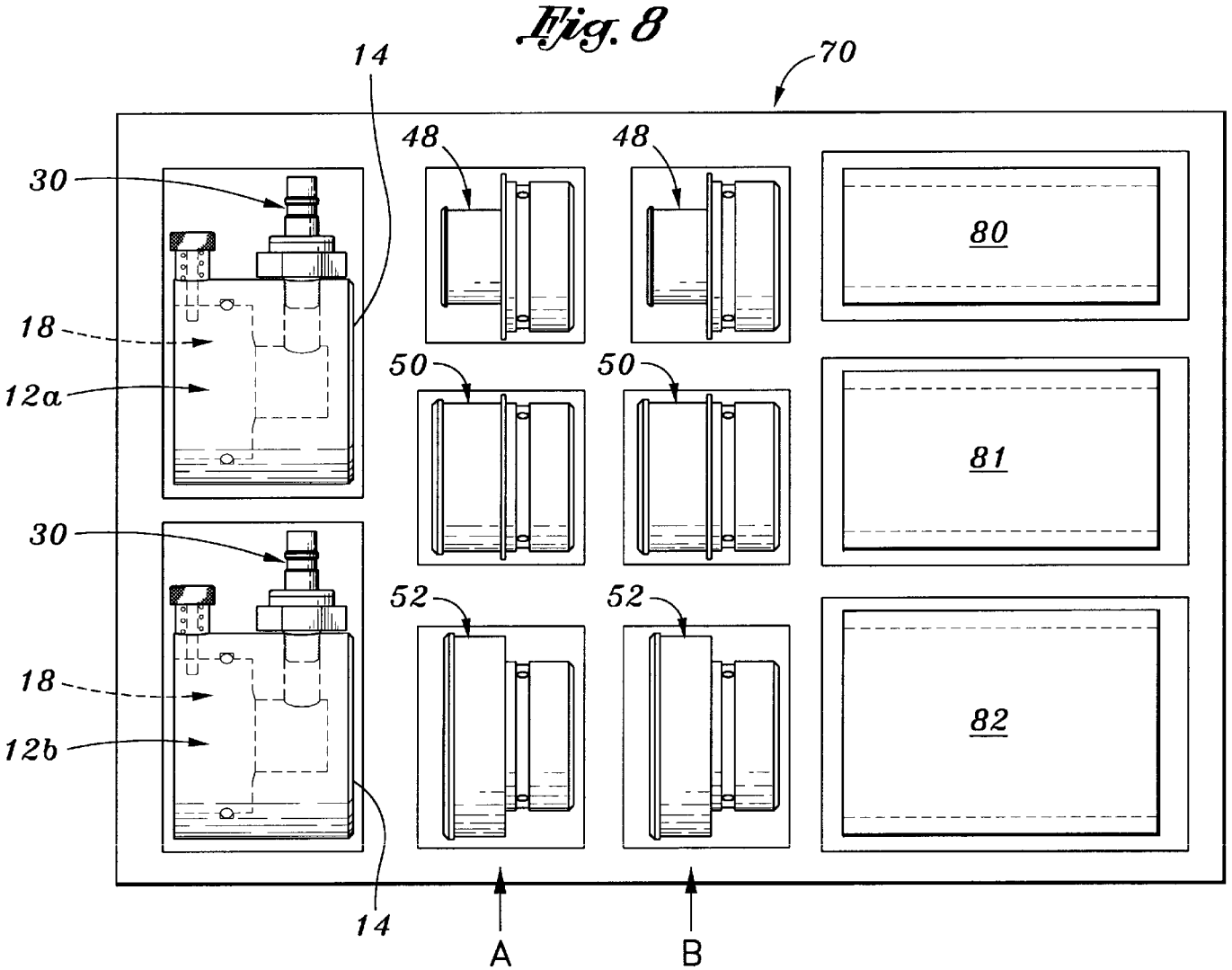
FIG. 8 is a plan view of kit containing a pair of adapters of this invention and replacement conduits for connection to the fluid transfer machine (FTM) as depicted in FIG. 7B.

As shown in FIG. 8, the kit 70 contains two adapter bodies 10*a* and 10*b*, two sets A and 5B of three small, medium, and large sized inserts, 48, 50, and 52, and three different sized replacement conduits 80, 81, and 82, respectively having small, medium, and large sized inside diameters that are, respectively, equal to the outside diameters of the three different sized radiator inlets 38*a* or outlets 36*a*. For any particular type of automotive vehicle, the radiator inlet and outlet have the same outside and inside diameters, but different vehicles will have different sized inlets and outlets as discussed above.

Each insert 48, 50 and 52 has a tubular construction with an end 55 that is identical for all these inserts. There is an opening O extending between the ends 53 and 55 with a uniform diameter through its length. The diameter of this opening O is the same for all the inserts 48, 50, and 52. The end 55 has a cylindrical configuration with a diameter equal to the diameter of the mouth 16*a* of the cavity 16 and a depth d equal to the depth of the cavity and a flat bottom 55*a*. A partition ledge 76 separates the end 53 and end 55, and next to this ledge is an annular groove 78 that has spaced apart radial recesses 79 therein that accept the tip 9*b* of the locking pin 9. At each end 53 is a raised lip 71 that assists in holding this end in the open end of a conduit into which it is inserted.

As depicted in FIG. 7B, a replacement conduit 80 from the set of three conduits 80–82 in the kit 70 is selected for use with a correctly sized insert selected from a set of three inserts 48, 50, and 52 in the kit 70. A pair of identical inserts are selected, one used in constructing each adapter 10*a* and 10*b*. In this case, the replacement conduit 80 that is sized to fit onto the outlet 36*a* is selected. This replacement conduit 80 has an inside diameter that is equal to the inside diameter of the conduit 36. An insert, in this cased, the insert 48, that fits within the selected conduit 80 is used. The adapters are then connected as shown in FIG. 7B so that new coolant fluid flows through the fluid transfer machine 62, hose 62*b*, the adapter 10*b*, and the conduit 36 into the engine 100, and old coolant fluid from the engine 100 flows through the conduit 38, radiator 46, replacement conduit 80, the adapter 10*a*, the hose 62*a*, and through the fluid transfer machine to storage or disposal.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. An adapter for connecting different sized conduits to an outlet or an inlet of a radiator for an automotive vehicle, each conduit having an open end configured differently than the open ends of the other conduits, said adapter including a body member having a cavity therein, a connection member having a first end extending from the body member to be attached to a coupling member and a second end in communication with the cavity, said connection member having a passageway extending from the first end to the second end, with said first end being normally closed but opening upon the connection member being attached to the coupling member to allow fluid to flow through the passageway into the cavity, and a plurality of tubular insert members that are individually and independently coupled to one sized conduit, each insert member having a first end sized to fit snug within the cavity and a second opposed end sized to fit within an open end of one of the conduits, the size of the said first ends of each insert member being substantially identical and the size of the second ends of each insert member being substantially different and configured to fit within only one open end of one of the conduits.

2. The adapter according to claim 1 where the body member is made of an insulating material.

3. The adapter according to claim 1 where the cavity has a cylindrical shaped sidewall with an "O" ring seated therein.

4. The adapter according to claim 1 where (a) the cavity has a substantially cylindrical shaped sidewall of a predetermined diameter and predetermined height, and a substantially flat bottom, and (b) the first end of each insert member has a substantially cylindrical shaped sidewall with a predetermined diameter and height substantially equal to said predetermined diameter and predetermined height of the cylindrical shaped sidewall of the cavity and terminates in a substantially flat bottom that abuts the bottom of the cavity upon insertion of the insert member into the cavity.

5. The adapter according to claim 1 where each tubular insert member has an inside diameter, and said inside diameters of each insert member are of equal diameter.

6. The adapter according to claim 1 where the first end of each insert member has an annular groove therein with a recess in the groove and the body member has a manually moveable locking pin extending there through with a terminal tip that rides in the groove and fits into the recess upon alignment therewith to lock the insert member to the body member.

7. A method of transferring coolant between a fluid transfer machine having a hose terminating in a coupling member and an automotive engine having a pair of radiator conduits, one radiator conduit connected to an inlet of a radiator for the automotive engine and the other radiator conduit connected to an outlet of said radiator, each radiator conduit having an inside diameter, said method comprising (a) disconnecting one of the radiator conduits, (b) substituting for the disconnected radiator conduit a replacement conduit, said replacement conduit having a length that is less than 3 inches, an inside diameter that is substantially the same as the inside diameter of the disconnected radiator conduit, and opposed open ends, with one of the open ends being attached to the radiator inlet or outlet depending on which radiator conduit has been disconnected, (c) providing an adapter including a body member having a cavity therein, a connection member having a first end extending from the body member that is adapted to be attached to the coupling member of the hose and a second end in communication with the cavity, said connection member having a passageway extending from the first end to the second end, with said first end being normally closed but opening upon the connection member being attached to said coupling member to allow fluid to flow through the passageway and cavity, and a plurality of tubular insert members, one of said insert members being individually and independently adapted to be coupled to one sized replacement conduit, each insert member having a first end sized to fit snug within the cavity and a second opposed end sized to fit only within an open end of one of a plurality of different sized replacement conduits, (d) selecting the tubular insert that has a second end that fits within the replacement conduit substituted for the disconnected radiator conduit and inserting said second end of this selected insert into the open end of the replacement conduit, and placing the first end of the selected tubular insert into the cavity, and (e) connecting the coupling member to the first end of the connection member.

8. A method of transferring coolant between a fluid transfer machine having a first hose terminating in a first coupling member and a second hose terminating in a second coupling member and an automotive engine having a pair of radiator conduits extending between a radiator for the automotive engine and the automotive engine, one radiator conduit having a first end connected to the radiator at a first connection point and a second end connected to the engine and another radiator conduit having a first end connected to the radiator at a second connection point and a second end connected to the engine, and each said radiator conduits having an inside diameter, said method comprising (a) disconnecting the first end of one of the radiator conduits from the radiator but leaving the second end of said disconnected radiator conduit connected to the engine, (b) attaching a replacement conduit to the radiator at the point of connection of the disconnected radiator conduit, said replacement conduit having a length that is less than 3 inches, an inside diameter that is substantially the same as the disconnected radiator conduit, and an open end with an inside diameter substantially the same as the disconnected radiator conduit, (c) providing first and second adapters, each adapter including a body member having a cavity therein, a connection member having a first end extending from the body member that is adapted to be attached to a coupling member of one hose of the fluid transfer machine and a second end in communication with the cavity, said connection member having a passageway extending from the first end to the second end, with said first end being normally closed but opening upon the connection member being attached to said coupling member to allow fluid to flow through the passageway and cavity, and a plurality of tubular insert members, one of said insert members being individually and independently adapted to be coupled to one sized replacement conduit, each insert member having a first end sized to fit snug within the cavity and a second opposed end sized to fit only within an open end of one of a plurality of different sized replacement conduits, (d) connecting the first adapter to the open end of the replacement conduit, including selecting the tubular insert that has a second end that fits within the replacement conduit attached to the connection point, inserting said second end of said selected insert into the open end of the replacement conduit, placing the first end of the selected tubular insert into the cavity of said first adapter, and connecting the first coupling member to the first end of the connection member of the first adapter, and (e) connecting the second adapter to the open end of the radiator conduit still connected to the engine, including selecting the tubular insert that has a second end that fits within the open end of the radiator conduit still connected to the engine, inserting said second end of said selected insert into the open end of the radiator conduit still connected to the engine, placing the first end of the selected tubular insert into the cavity of said second adapter, and connecting the second coupling member to the second end of the connection member of the second adapter.

9. A method of replacing coolant in a radiator that flows through a radiator conduit to an automotive engine, said radiator conduit having first and second opposed ends, said method comprising (a) detaching one end of the radiator conduit connected to the radiator and leaving the other end of said the radiator conduit connected to the engine, (b) attaching one end of a replacement conduit to the radiator to replace the radiator conduit and attaching another end of the replacement conduit to a fluid transfer machine via a first adapter having a removable insert with a predetermined size substantially the same as the disconnected radiator conduit to enable the one end of the replacement conduit to be connected to the radiator, said fluid transfer machine being in communication with a source of new coolant and having a first outlet for used coolant from the radiator and a second outlet for new coolant to be fed to the engine, (c) connecting the second outlet of the fluid transfer machine to the engine via a second adapter having a removable insert with a predetermined size substantially the same as the disconnected radiator conduit to enable the second adapter to be connected to the engine.

10. A kit used to connect a coolant fluid transfer machine to an automotive engine, including at least one set of conduits, each conduit having a different inside diameter, each conduit each having an open end configured differently than the open ends of the other conduits, at least one set of adapters for connecting the different sized inside diameters of the conduits to an outlet or an inlet of a radiator for the automotive vehicle, each said adapter including a body member having a cavity therein, a connection member having a first end extending from the body member to be attached to a coupling member and a second end in communication with the cavity, said connection member having a passageway extending from the first end to the second end, with said first end being normally closed but opening upon the connection member being attached to the coupling member to allow fluid to flow through the passageway into the cavity, and a plurality of tubular insert members that are individually and independently coupled to one sized conduit, each insert member having a first end sized to fit snug within the cavity and a second opposed end sized to fit within an open end of one of the conduits, the size of the said first ends of each insert member being substantially identical and the size of the second ends of each insert member being substantially different but configured to fit within only one open end of one of the conduits.

* * * * *